United States Patent [19]

Cervantes, Sr.

[11] Patent Number: 4,679,652

[45] Date of Patent: Jul. 14, 1987

[54] AUTOMATICALLY ADJUSTABLE LADDER SUPPORT

[76] Inventor: Ramiro E. Cervantes, Sr., 3127 Dorchester Ave., Los Angeles, Calif. 90032

[21] Appl. No.: 840,098

[22] Filed: Mar. 17, 1986

[51] Int. Cl.[4] ..... E06C 5/36; E04G 1/14

[52] U.S. Cl. ..... 182/200; 248/188.3

[58] Field of Search ..... 182/200, 107; 248/188.3, 188.2

[56] References Cited

U.S. PATENT DOCUMENTS

| | | | |
|---|---|---|---|
| 3,805,917 | 4/1974 | Luther | 182/200 |
| 4,069,893 | 1/1978 | Blackstone | 182/200 |
| 4,359,138 | 11/1982 | Kümmerlin et al. | 182/200 X |

*Primary Examiner*—Ramon S. Britts
*Assistant Examiner*—Karen J. Chotkowski
*Attorney, Agent, or Firm*—George J. Netter

[57] ABSTRACT

A ladder support has pedestals universally mounted so as to accommodate irregular ground surfaces. Each pedestal is an enlarged circular affair providing frictional engagement with the ground plane. A pair of spring-loaded jaws extend parallel to one another for receiving the lower end of the ladder, and which, due to the weight of the ladder, are levered against a resistant spring force causing the jaws to close on the end of the ladder and secure it by clamping engagement. The jaws are mounted on end plates which are, in turn, pivotally mounted onto end wall assemblies that can rotate providing a self-adjustment of the lower end of the ladder between the jaws.

5 Claims, 8 Drawing Figures

11
12
13
14
15
16
17
18
19
20
21
22
23
24
25
26
27
28
29
30
31
32
34
35
6

AUTOMATICALLY ADJUSTABLE LADDER SUPPORT

The present invention relates generally to ladders, and, more particularly, to a support for the lower end of a ladder which automatically accommodates for irregularities in the ground surface and secures the lower end of the ladder against shifting or inadvertent slipping that would cause the ladder to fall.

BACKGROUND

In the use of a ladder, especially in the construction environment or industrial uses, the lower end of the ladder may have to be placed on a surface which is irregular and perhaps slippery or sloping. In other circumstances, the support surface on which the ladder is to be placed is uneven such that there is not equal and uniform support for the ladder making it dangerous to use.

OBJECTS AND SUMMARY OF THE INVENTION

It is therefore a primary aim and object of the present invention to provide a self-adjusting support for the lower end of the ladder which can automatically compensate for irregularities in the ground plane and maintain the ladder lower end in a firm and secure manner.

It is another object of the invention to provide an automatically adjustable support which clampingly engages the lower end of the ladder to prevent it from experiencing lateral shifting movement.

In the practice of the present invention there is provided a support means having pedestals which are universally mounted so as to accommodate irregular ground surface. Additionally, the pedestals are enlarged circular affairs providing a relatively large frictional engagement with the floor, ground or other supporting surface. A pair of spring-loaded jaws which extend parallel to one another are adapted to receive the lower end of the ladder therebetween and which simultaneously, due to the weight and the force of the ladder being received therein, are levered against a resistant spring force causing the jaws to close on the end of the ladder and secure it by clamping engagement therebetween. The two jaws are mounted on end plates which are, in turn, pivotally mounted onto a base member such that when the lower end of the ladder is received between the two jaws in their open position, the entire assembly of the jaws can rotate and thereby provide a self-adjustment of the lower end of the ladder between the jaws.

DESCRIPTION OF A PREFERRED EMBODIMENT

Figure 1:
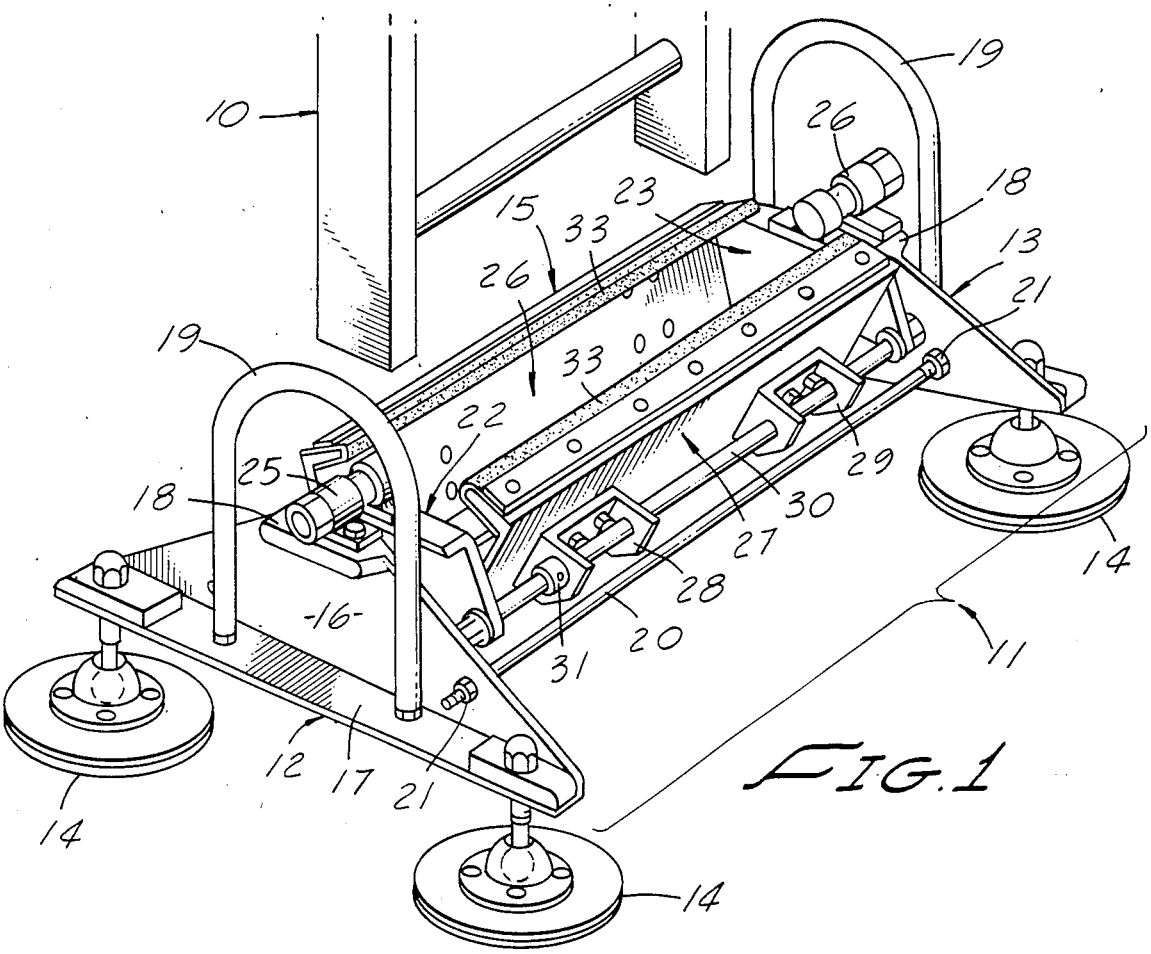
FIG. 1 is a perspective view of the ladder support apparatus of this invention.
Figure 2:
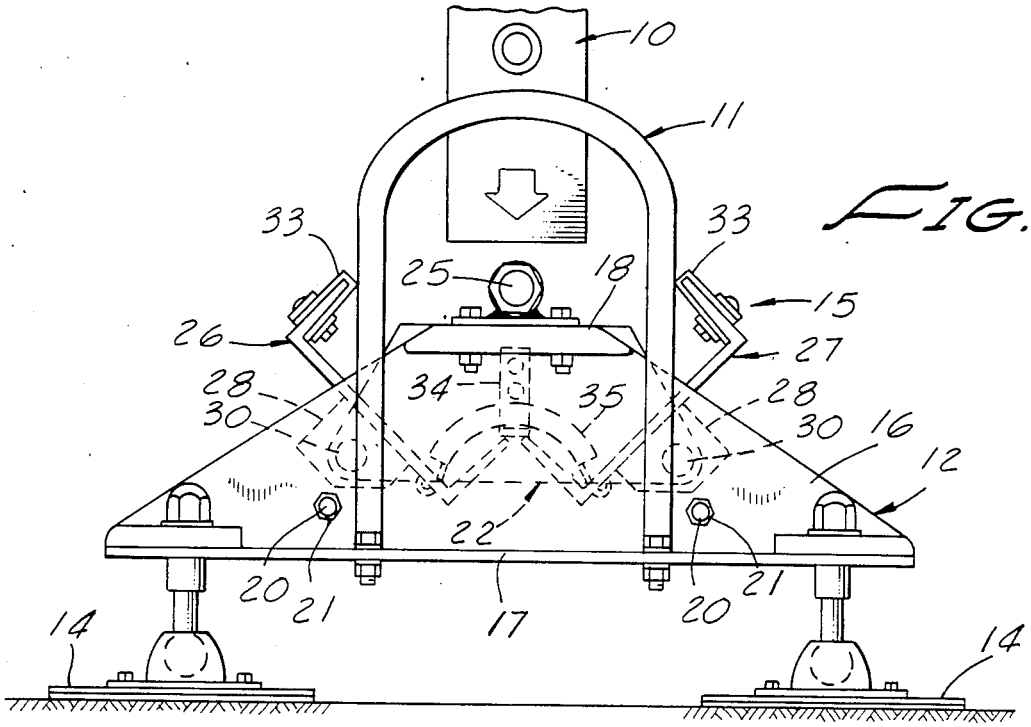
FIG. 2 is an end elevational view of the apparatus of FIG. 1.

Turning now to the drawings, and particularly FIG. 1, the self-adjusting support apparatus to be described for securing the lower end of a ladder 10 is enumerated generally as at 11. In its major parts the apparatus 11 includes first and second end wall assemblies 12 and 13 each having a pair of pedestals 14 for resting support on a ground plane, and a self-adjusting clamping and securing means 15 which is pivotally mounted between the two end wall assemblies 12 and 13. Briefly, as to general operation, the entire apparatus rests on a ground plane on the four pedestals 14 and the ladder is placed within the self-adjusting clamping and securing means 15 which through pivoting and clamping actions to be described automatically secures and holds the lower end of the ladder in a safe and secure manner.

The two end wall assemblies 12 and 13 are substantially identical in construction and, therefore, only the detailed aspects of the end wall assembly 12 will be given. The end wall assembly has a relatively flat substantially triangular plate 16 including a first flange 17 extending outwardly therefrom along a lower edge, and at the top of the triangular plate 16 there is a second flange 18 extending in the same direction as flange 17. A pair of pedestals 14 are secured to the lower surface of the flange 17 at opposite ends of the flange and extending downwardly. Also, a U-shaped grip 19 has its two ends secured to the upper surface of the flange 17 with the closed part thereof extending upwardly and generally parallel to the triangular plate 16.

The two end wall assemblies 12 and 13 are maintained in a spaced, predetermined manner by first and second spacer rods 20 received through suitably dimensioned openings in the respective triangualr plates 16 of each assembly with nuts 21 received on each side of the triangular plate for securing the rods to the plates and thus to the entire assemblies.

Figure 3:
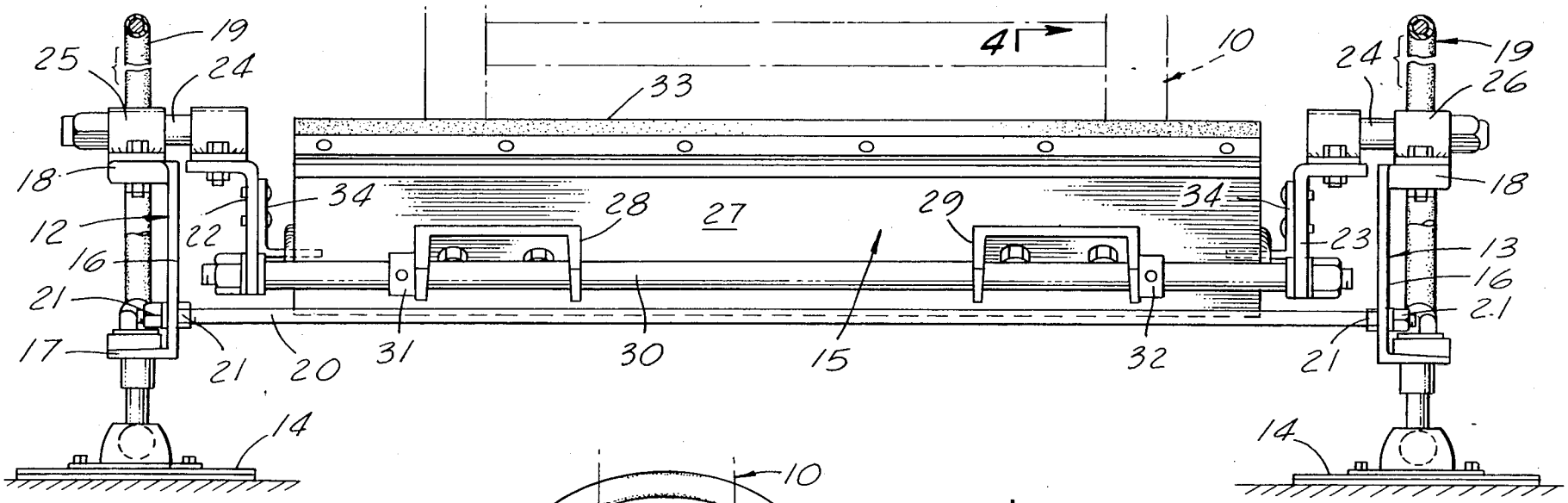
FIG. 3 is a front elevational view of the apparatus of FIG. 1.
Figure 4:
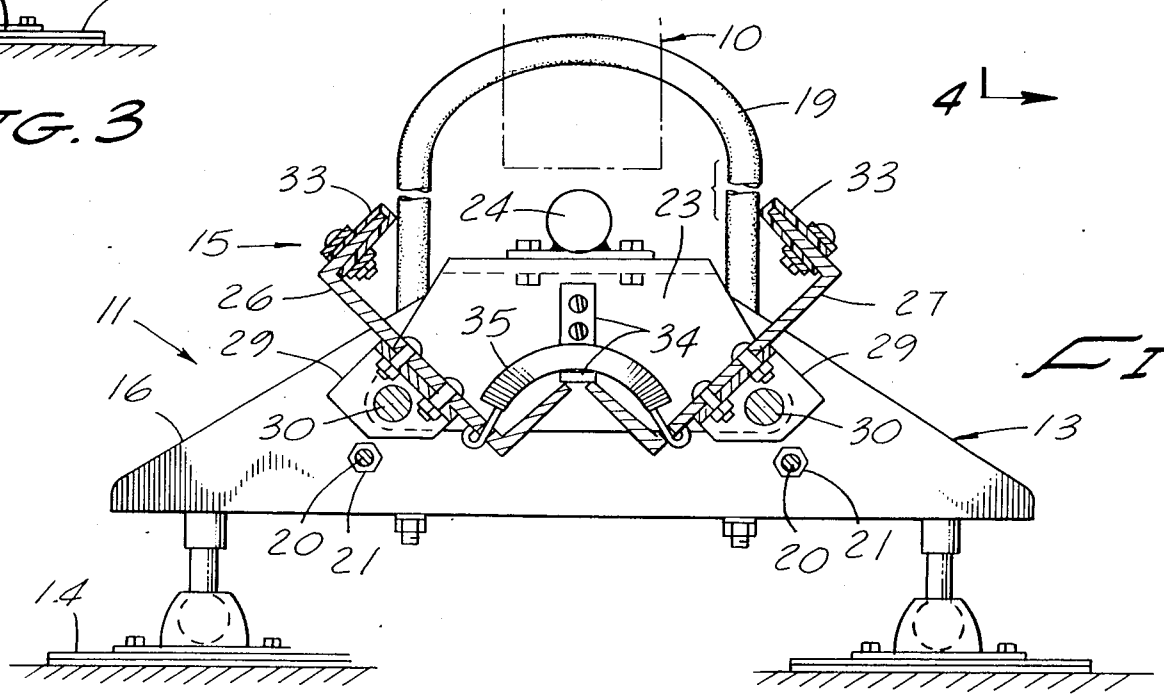
FIG. 4 is an end elevational, sectional view taken along the line 4—4 of FIG. 3.
Figures 5, 6:
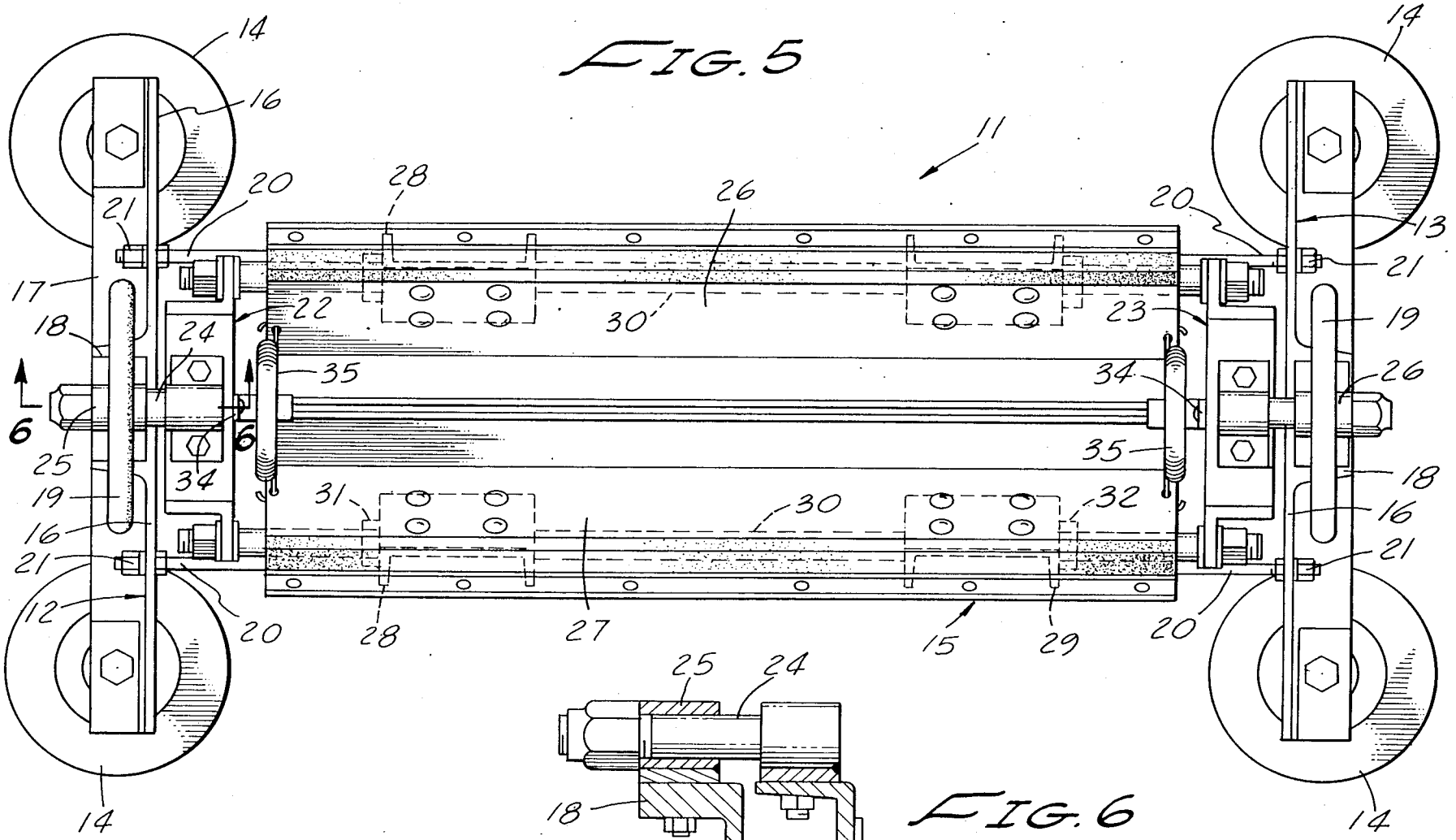
FIG. 5 is a top plan view.
FIG. 6 is a sectional view taken through the pivot along line 6—6 of FIG. 5.

For the ensuing description of the self-adjusting and clamping means 15 reference is simultaneously made to FIGS. 3, 4 and 5. The means 15 is mounted via first and second end plates 22 and 23 for pivoting or swinging movement with respect to the first and second end walls assemblies. More particularly, each end plate 22, 23 consists of a generally rectangular plate having a flange along its upper edge which extends at substantially 90 degrees thereto. A rod 24 is suitably affixed to the upper surface of the end plate flange to extend toward the end wall assembly where it is journaled as at 25 and 26, respectively, on the flange 18 of the end wall assembly. First and second jaws 26 and 27 each consist of an elongated C-shaped in cross-section channel iron (FIG. 4). As can be seen best in FIG. 3, a pair of bifurcated brackets 28 and 29 are affixed to the outer surface of the jaw 27 with the channel arms or legs extending in an opposite direction. A pivot rod 30 has its ends secured within suitably dimensioned openings in the end plates 22 and 23 and passes through openings in the arms of the bifurcated members 28, 29. Collars 31 and 32 are affixed to the rod 30 serving to position the jaw 27 properly therealong in a generally evenly spaced relation between the two end plates 21 and 22. By this construction, the jaw can pivot about the pivot rod 30 as an axis.

The jaw 26 is also mounted in the same way as the jaw 27 and, as shown in FIG. 4, the two jaws can be pivoted toward each other to provide a closed gripping arrangement of the top or upper jaw edges, or, alternatively to the open position. The upper edge of the jaw arm is enclosed in a material such as rubber or leather or plastic 33 to provide a highly frictionally gripping surface for a purpose to be described.

On the surface of each end plate 22 and 23 that faces toward the jaws, there is provided an L-shaped bracket 34 affixed to that surface and including an arm which extends a short distance between the two jaws just above and opposite the lower arms of the C-shaped jaws (compare FIGS. 3 and 4). These brackets will intercept the upper ends of the lower arms of each of the jaws when they are moved to their maximum opening position as shown in FIG. 4 and thereby defining a limit to the opening of the jaws. A pair of coil springs 35, each having hooked ends, are secured through openings in the wall of each of the two jaws with a central part of the spring extending up and over the respective brackets 34 (FIG. 4). As can be seen from comparing FIGS. 4, 7 and 8, movement of the jaws toward the closed position places the spring 35 in ever greater tension until a maximum is released when the jaws are closed. The strength of the spring at its maximum closed condition (FIG. 4) must be less than that corresponding to the weight of the ladder placed within the jaws in order to have proper operation of the apparatus, as will be explained.

Figure 7:
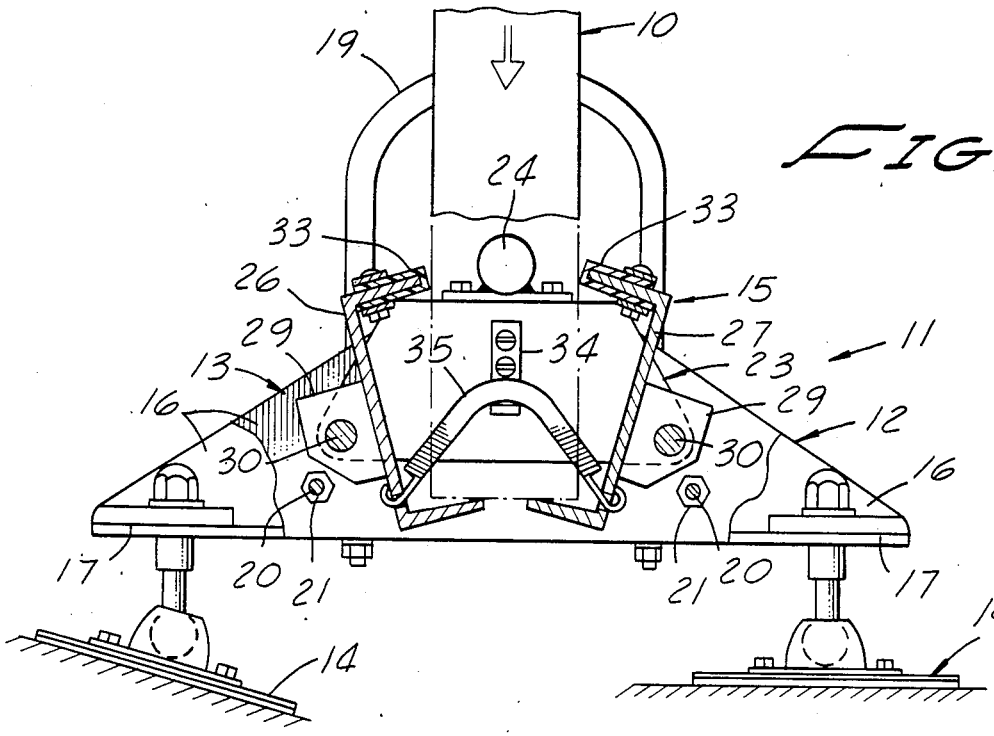
FIG. 7 is an end elevational view showing the supporting means resting with one of its pedestals on uneven ground or a sloping surface.
Figure 8:
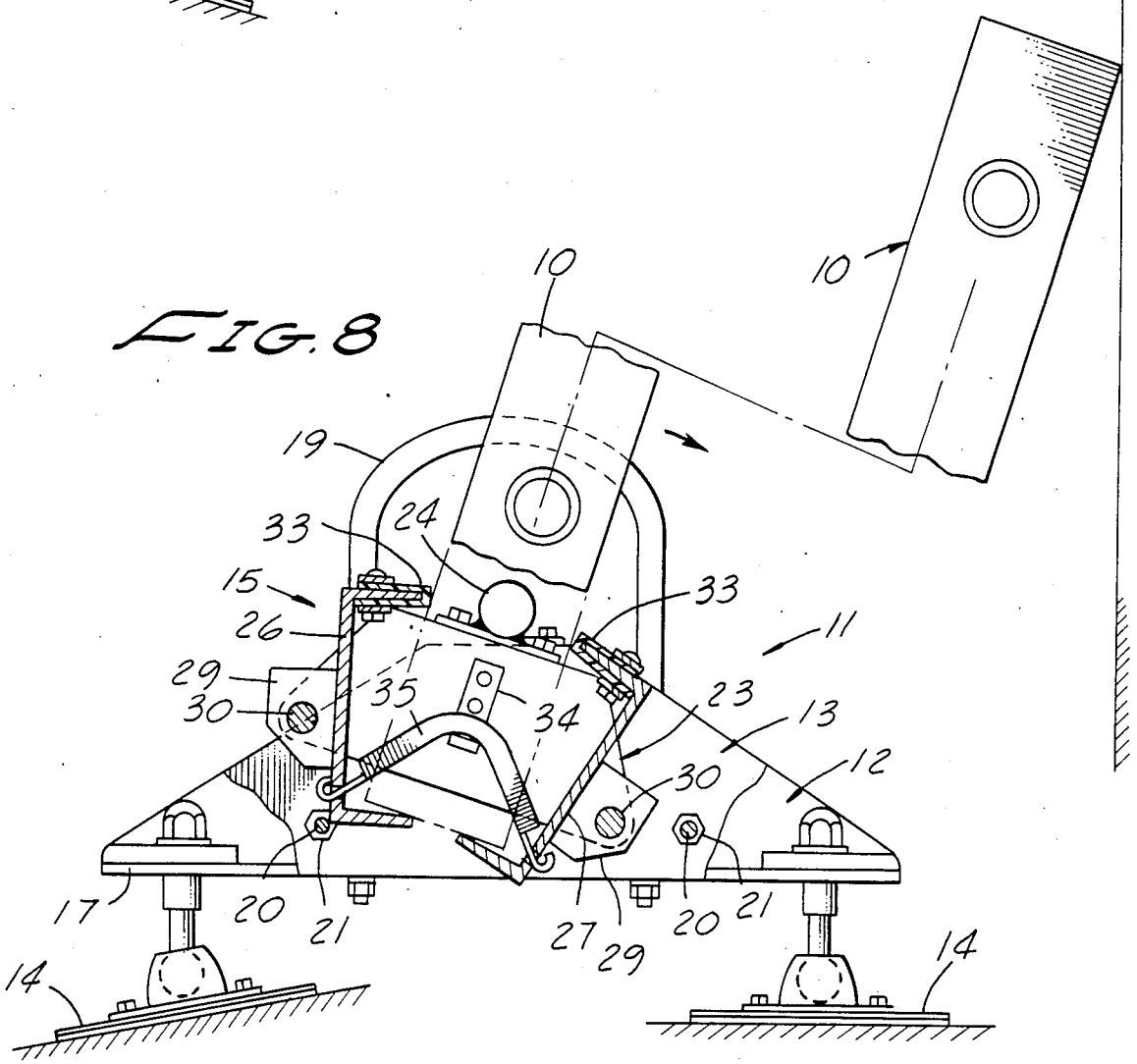
FIG. 8 is a further view of the apparatus similar to FIG. 7 showing the apparatus resting with one of its pedestals on sloping ground and the ladder clamped within the supporting apparatus and arranged at a substantial angle to the ground or support surface.

In operation and use, the self-adjusting apparatus 11 is appropriately located on the ground plane immediately below where the ladder is to be located. The lower end of the ladder 10 is then brought down from above the apparatus as shown in FIG. 1 until it is received between the open jaws 26 and 27, and rests on the upper edges of the lower cross arms of each of the jaws (FIG. 7). As the weight of the ladder is allowed to be applied directly onto the cross-arms of the jaws, the jaws close toward one another against the spring tension until the upper edges clamp into the side of the ladder lower portion of the ladder (FIG. 7). At this time, the lower end of the ladder is securely held with a relatively large angle of pivoting about the axis of rods 24 automatically locating the ladder at the mound angle with respect to the supporting apparatus. Even with substantial variation in the angle of the ladder with respect to the supporting apparatus, the force and weight of the individual on the ladder as well as the ladder itself is directed into the base of the supporting apparatus, thereby ensuring stability of the ladder. Of course, by increasing the size of the base with respect to the normal two point support of a ladder in its usual use, the stability is enhanced by keeping the center of gravity above the base.

I claim:

1. A self-adjusting support for a ladder, comprising:

first and second end plates mounted in fixed predetermined spaced apart relation exceeding the width of the lower end portion of the ladder;

a pair of jaw means pivotally mounted to said first and second end plates for pivoting from a first positon with the jaw means closed on each other to a second position where the means are spaced apart a sufficient amount to enable receipt of the ladder lower end portion therebetween;

spring means interconnecting the jaws means for urging them to the second position; and a pair of end wall assemblies supporting the first and second end plates on a ground plane.

2. A self-adjusting support for a ladder as in claim 1, in which the first and second end plates are pivotally mounted to said pair of end wall assemblies about an axis parallel to pivoting axis of the jaw means.

3. A self-adjusting support for a ladder as in claim 1, in which a pair of pedestals are affixed to a lower surface of each end wall assembly.

4. A self-adjusting support for a ladder as in claim 3, in which each pedestal is connected to an end wall assembly via a ball and socket providing universal adjustment of the pedestal.

5. A self-adjusting support for a ladder, comprising:

first and second end plates mounted in fixed predetermined spaced apart relation exceeding the width of the lower end portion of the ladder;

a pair of jaw means pivotally mounted to said first and second end plates for pivoting from a first position with the jaw means closed on each other to a second position where the jaw means are spaced apart a sufficient amount to enable receipt of the ladder lower end portion therebetween;

each jaw means includes an elongated manner with a longitudinally extending clamping surface and a longitudinally extending actuating surface spaced from said clamping surface, and each said jaw means being mounted for pivoting about a longitudinal axes from the first position where the clamping surfaces are in contact and the actuating surfaces are separated to the second position where the clamping surfaces are separated and the actuating surfaces are in contact;

coil spring means interconnecting the jaw means to each other for urging the jaw means toward the second position; and a pair of end wall assemblies supporting the first and second end plates on a ground plane.

* * * * *